US011499709B2

(12) United States Patent
Holopainen et al.

(10) Patent No.: US 11,499,709 B2
(45) Date of Patent: Nov. 15, 2022

(54) BOTTOM-SUPPORTED BOILER HAVING A BOILER PRESSURE BODY AND A FOUR VERTICAL COLUMN SUPPORT CONSTRUCTION

(71) Applicant: Sumitomo SHI FW Energia Oy, Espoo (FI)

(72) Inventors: Heikki Holopainen, Pieksämäki (FI); Jussi Pollari, Kuopio (FI)

(73) Assignee: Sumitomo SHI FW Energia Oy, Espoo (FI)

( * ) Notice: Subject to any disclaimer, the term of this patent is extended or adjusted under 35 U.S.C. 154(b) by 0 days.

(21) Appl. No.: 16/097,994

(22) PCT Filed: Jun. 20, 2016

(86) PCT No.: PCT/FI2016/050447
§ 371 (c)(1),
(2) Date: Oct. 31, 2018

(87) PCT Pub. No.: WO2017/220846
PCT Pub. Date: Dec. 28, 2017

(65) Prior Publication Data

US 2019/0154251 A1 May 23, 2019

(51) Int. Cl.
*F22B 37/24* (2006.01)

(52) U.S. Cl.
CPC ..... *F22B 37/242* (2013.01)

(58) Field of Classification Search
CPC ..... F22B 37/24; F22B 37/20; F22B 37/242; F22B 37/244; F22B 37/246; F22B 37/248; F28F 2265/26
See application file for complete search history.

(56) References Cited

U.S. PATENT DOCUMENTS 1,813,058 A * 7/1931 Lasker ..... F22B 37/20 122/235.11
3,280,800 A 10/1966 Sullivan
(Continued)

FOREIGN PATENT DOCUMENTS

CN 1603680 A 4/2005
CN 101303121 A 11/2008
(Continued)

OTHER PUBLICATIONS

Office Action dated Aug. 19, 2019, issued in corresponding Chinese Patent Application No. 201680086945.7.
(Continued)

*Primary Examiner* — Steven S Anderson, II
(74) *Attorney, Agent, or Firm* — Venable LLP

(57) ABSTRACT

A bottom-supported boiler that includes a boiler pressure body having a rectangular horizontal cross section formed by joining four planar water tube walls pairwise together so as to form four corners with water tube walls being formed with fins welded between the water tubes, and a support construction including four vertical columns vertically supported to the ground. The vertical columns are arranged outside of the boiler pressure body so that adjacent to each of the corner corners is arranged one of the four vertical columns. Each of the vertical columns is directly connected with a rigid joint to a respective corner so that vertical loads of the boiler pressure body are balanced by the four vertical columns, and so that the water tube walls are supported from their sides by the four vertical columns so that the weight of the boiler pressure body is transferred through the vertical columns, and such that each of the four vertical columns is directly attached to a respective corner.

18 Claims, 3 Drawing Sheets

(56) References Cited

U.S. PATENT DOCUMENTS

| | | | | | |
|---|---|---|---|---|---|
| 3,811,415 | A | | 5/1974 | Lawrence | |
| 3,927,714 | A | * | 12/1975 | Stogmuller | F22B 37/20 165/82 |
| 4,033,298 | A | | 7/1977 | Sullivan | |
| 5,370,239 | A | * | 12/1994 | Kidaloski | F22B 37/001 211/189 |
| 8,393,304 | B2 | | 12/2013 | Lankinen | |
| 9,194,609 | B2 | * | 11/2015 | Iannacchione | F24S 20/20 |
| 9,964,301 | B2 | * | 5/2018 | Lankinen | F22B 31/0084 |
| 2008/0276885 | A1 | | 11/2008 | Seppanen et al. | |
| 2016/0123574 | A1 | | 5/2016 | Lankinen et al. | |

FOREIGN PATENT DOCUMENTS

| | | | | | |
|---|---|---|---|---|---|
| CN | 101868676 | A | | 10/2010 | |
| CN | 102393003 | A | | 3/2012 | |
| CN | 205118991 | U | | 3/2016 | |
| DE | 15 26 931 | A1 | | 4/1970 | |
| DE | 1526931 | A1 | * | 4/1970 | F22B 37/207 |
| DE | 27 48 650 | A1 | | 5/1979 | |
| DE | 102010002737 | A1 | | 6/2011 | |
| EP | 0760071 | B1 | | 10/1997 | |
| GB | 371100 | A | | 4/1932 | |
| GB | 887508 | A | | 1/1962 | |
| JP | S46-007651 | A | | 12/1971 | |
| JP | 2014-129943 | A | | 7/2014 | |
| JP | 2014-234976 | A | | 12/2014 | |
| KR | 1020160008643 | A | | 1/2016 | |
| WO | 2015/185796 | A1 | | 12/2015 | |

OTHER PUBLICATIONS

Office Action dated Mar. 30, 2020, issued in corresponding Chinese Patent Application No. 201680086945.7.

Office Action dated Oct. 16, 2019, issued in corresponding Japanese Patent Application No. 2018-556928.

Office Action dated Mar. 11, 2020, issued in corresponding Japanese Patent Application No. 2018-556928.

Office Action dated Nov. 11, 2019, issued in corresponding Korean Patent Application No. 10-2018-7037296.

Notification of Transmittal of the International Search Report and the Written Opinion of the International Searching Authority, or the Declaration, International Search Report, and Written Opinion, dated Mar. 20, 2017, in corresponding International Patent Application No. PCT/FI2016/050447.

Office Action dated Aug. 20, 2020, issued in corresponding Chinese Patent Application No. 201680086945.7 (with English translation).

Office Action dated Jan. 1, 2021, issued in corresponding Indian Patent Application No. 201947001546.

Notice of Opposition dated Nov. 30, 2020, issued in corresponding European Patent Application No. 16735668.2.

Office Action dated Feb. 22, 2021, issued in corresponding Japanese Patent Application No. 2018-556298 (with English translation).

Office Action dated Dec. 30, 2021, issued in corresponding Malaysian Patent Application No. PI 2018002343 (3 pages).

Office Action issued in corresponding Philippines Patent Application No. 1/2018/502362 (8 pages).

Office Action dated Jul. 12, 2022, issued in corresponding Chinese Patent Application No. 201680086945.7.

Dao-Zhi Lu, "Industrial Boiler Stoker Tutorial," Aviation Industry Press, 1st edition, pp. 64-66 (3 pages), Apr. 30, 2001.

* cited by examiner

BOTTOM-SUPPORTED BOILER HAVING A BOILER PRESSURE BODY AND A FOUR VERTICAL COLUMN SUPPORT CONSTRUCTION

CLAIM TO PRIORITY

This application is a U.S. national stage application of PCT International Patent Application No. PCT/FI2016/050447, filed Jun. 20, 2016.

FIELD OF THE INVENTION

The present invention relates to a bottom-supported boiler. More particularly, the invention relates to a bottom-supported boiler comprising a boiler pressure body, such as a furnace, a convection cage, an empty pass, a solid separator, or a horizontal pass, and a construction for supporting the boiler pressure body.

DESCRIPTION OF THE RELATED ART

Relatively large boiler pressure bodies, such as tube walled furnaces, are generally arranged top-supported, i.e., so that the boiler pressure body is arranged to hang from a rigid supporting structure. Relatively small boiler pressure bodies are conventionally arranged as bottom-supported, wherein a vertical load of the boiler pressure body is balanced solely by a support construction arranged below the boiler pressure body. The main difference between top-supported and bottom-supported constructions is that when the temperature of the boiler pressure body increases, thermal expansion of a top-supported boiler pressure body takes place mainly downwards whereas in a bottom-supported boiler pressure body thermal expansion takes place mainly upwards. Bottom-supported boiler pressure bodies are generally simpler and economically more advantageous than top-supported boiler pressure bodies, because they do not require a separate supporting structure. A disadvantage of bottom-supported construction is that the walls have to be strong enough to carry the vertical compression load of the boiler pressure body. Therefore, bottom-supported construction is conventionally applied only for relatively small boiler pressure bodies, such as furnaces of power boilers with a capacity of less than 40 MWe.

U.S. Pat. No. 3,280,800 discloses a conventional bottom-supported boiler, comprising a self-standing tube-walled furnace and a boiler bank downstream of the furnace, supported by a downcomer. Bottom support for the furnace is provided by a plurality of support members mounted atop pedestals and adapted to engage, either fixedly or slidably, headers of the wall tubes.

U.S. Pat. No. 3,927,714 discloses a bottom-supported boiler comprising a frame of vertical down pipes and return pipes connected by manifolds and headers, and provides from below vertical support to vertical water tubes connected between the manifolds and headers.

German Patent No. 27 48 650 discloses a bottom-supported boiler comprising in U-form bent evaporation tubes within the boiler, in which the outermost portions of the evaporation tubes are connected to an opposite water tube wall so as to provide vertical support for the evaporation tubes.

An object of the present invention is to provide a bottom-supported boiler with an improved support construction for vertical water tube walls of a boiler pressure body.

SUMMARY OF THE INVENTION

According to one aspect, the present invention provides a bottom-supported boiler comprising a boiler pressure body having a rectangular horizontal cross section formed by joining four planar water tube walls pairwise together so as to form four corner sections, and a support construction, wherein the support construction comprises four vertical columns vertically supported to the ground, the vertical columns being arranged outside the boiler pressure body so that adjacent to each of the corner sections is arranged one of the four vertical columns, wherein each of the vertical columns is attached to the respective corner section.

According to the invention, vertical loads, such as gravitational forces and forces caused by seismic loads and direct wind loads, of the boiler pressure body are balanced, i.e., transferred to the ground or foundations of the boiler, by the four vertical columns, advantageously, solely by the four vertical columns. This differs from a conventional solution in which the weight of the boiler pressure body is transferred to be through the wall tubes, whereby the bottom sections of the water tubes are heavily loaded and relatively densely disposed buckstays are required to avoid excess compression and flexular buckling of the water tube panels. The present invention also minimizes the need to use especially large diameter thick-walled tubes, as required if conventional solution is applied to relatively large boilers, to obtain sufficient stiffness and strength of the tube walls. When using the present solution, the use of multiple support members, most of them sliding support members, below each bottom header of the wall tubes, to support the bottom headers from supporting steel structure, is also avoided, as well as tedious shimming of the support members to balance force distribution between the support members.

The four vertical columns are preferably substantially as high as the boiler pressure body, but, in some applications, they may alternatively have a smaller height than the boiler pressure body. Thereby, the four vertical columns are preferably attached to the respective corner sections in a region having a height of at least 30% of the height of the boiler pressure body, even more preferably, a height of at least 60% of the height of the boiler pressure body. In some cases, when the vertical columns also have other functions than just supporting the pressure body, for example, supporting a steam drum, the vertical columns, or at least some of them, may extend even higher than the boiler pressure body. When vertical columns as high as, or higher than, the boiler pressure body are used, the four vertical columns are advantageously attached to the respective corner sections in a region having a height that substantially equals the height of the boiler pressure body.

According to an advantageous embodiment of the present invention, each of the four vertical columns is attached to the respective corner section by a continuous metal strip that provides, in the vertical direction, a rigid joint. The metal strip is advantageously dimensioned so that it provides, in addition to the desired rigidity, also so good thermal contact between the corner section and the vertical column that they stay in substantially equal temperature. The attaching is advantageously made with a continuous weld to a corner fin between outermost water tubes of the water tube walls forming the corner section.

Thermal expansion of the planar water tube walls of the boiler pressure body takes place mainly upwards. However, thermal expansion generally takes place, usually, to a smaller amount, also in the horizontal direction. According to an advantageous embodiment of the present invention, horizontal thermal expansion is taken into account by supporting at least some of the four vertical columns to the ground by using conventional sliding elements. In such a case, most preferably, all four vertical columns are supported by a sliding element, and horizontal movements of the boiler pressure body are prevented by suitable guiding elements. It is, however, also possible that one of the vertical columns is fixed to the ground or foundation of the boiler, and the other three vertical columns are supported by a sliding element.

Advantageously, the four vertical columns are supported to the ground by a support steel construction below the vertical columns. The support steel construction advantageously comprises a second vertical steel column below each of the four vertical columns. When sliding supporting elements are used, the support steel construction is advantageously substantially rigid. According to another preferred embodiment, the support steel construction is designed to be flexible to render sufficient bending of the support steel construction possible, to allow horizontal thermal expansion of the planar water tube walls without sliding elements between the vertical columns and the support steel construction. According to a preferred embodiment of the present invention, the support steel construction comprises below the boiler pressure body an upper portion that is flexible to allow horizontal thermal expansion of the planar water tube walls without sliding elements, and a rigid lower portion, such as foundations of the boiler.

According to a preferred embodiment of the present invention, at least one, preferably each, of the four vertical columns is a boiler pipe. Advantageously, the boiler pipes are downcomer pipes of the boiler, but, in some applications, they could also be, for example, steam pipes. By using the downcomer pipes as the vertical columns, the need for special supporting of the downcomer pipes is minimized. Because the water in the downcomer pipes is nearly at the same temperature as the water in the water wall tubes, there is not any significant thermal stress between the water tube walls and the downcomer pipes.

According to another preferred embodiment of the present invention, which is especially applicable when downcomer pipes or other suitable boiler pipes are not available, at least one of the multiple vertical columns is a not a boiler pipe. Such a vertical column can be, for example, a separate hollow vertical beam with a square cross section. Such separate hollow vertical beams, which are dedicated to the use as the vertical columns, have the advantage that their sizes are more freely selected, and their sizes can even change with the elevation. When using such separate hollow beams as the vertical columns, minimizing temperature difference between the water tube walls and the vertical columns has to be ensured by using especially good thermal conductivity providing metal strips between the water tube walls and the vertical columns. In order to minimize the temperature difference, each of the four vertical columns, no matter of being, for example, a boiler pipe or a hollow vertical beam, is preferably arranged inside a common thermal insulation with the boiler pressure body.

The present invention is especially applicable when the boiler is a bottom-supported fluidized bed boiler, such as bubbling bed boiler, or a pulverized coal (PC) boiler. By using the present invention, it is possible to make bottom-supported boilers with a capacity of, for example, as high as 70 MWe, or even higher. According to other advantageous embodiments of the present invention, the boiler pressure body is one of a furnace, a convection cage in connection with a furnace, an empty pass in connection with a furnace, a solid separator in connection with a furnace, or a horizontal pass in connection with a furnace.

The present invention also renders possible an especially straight forward design of the boiler, clearly faster erection of the boiler than by using conventional methods, and a remarkable reduction in the quantities of the required steel structures.

The above brief description, as well as further objects, features, and advantages of the present invention will be more fully appreciated by reference to the following detailed description of the currently preferred, but nonetheless illustrative, embodiments in accordance with the present invention, when taken in conjunction with the accompanying drawings.

DETAILED DESCRIPTION OF THE PREFERRED EMBODIMENTS

Figure 1:
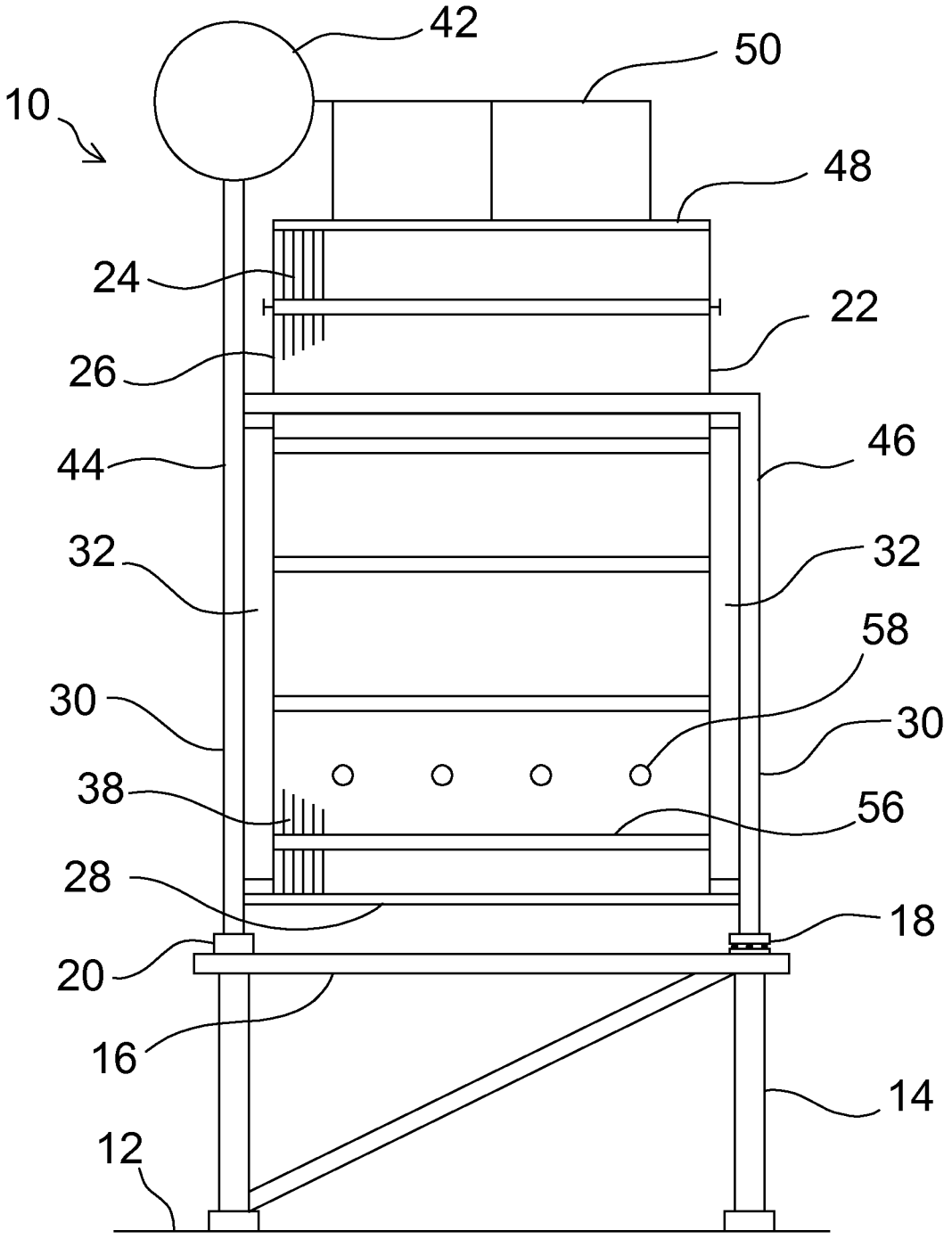
FIG. 1 schematically illustrates a side view of a boiler according to a first preferred embodiment of the present invention.

The diagram of FIG. 1 schematically illustrates a side view of a bottom-supported bubbling bed boiler 10, representing an embodiment of the present invention. The bubbling bed boiler 10 is self-standing and supported to the ground 12 via a rigid support steel construction 14 arranged below the boiler. Thus, thermal expansion of the boiler takes place upwards from the support steel construction 14. However, in practice, there is also thermal expansion in the horizontal direction, parallel to horizontal beams 16 of the support steel construction. The latter is taken into account by having the boiler at least partially supported on the support steel construction 14 by suitable sliding support elements 18. FIG. 1 shows one sliding support element 18 and one fixed support element 20, but it is also possible that the boiler is supported on the support steel construction solely by sliding support elements.

The boiler 10 comprises a boiler pressure body 22 made of four planar water tube walls 24, only one of which can be seen in FIG. 1. The water tube walls 24 are formed in a conventional manner of vertical water tubes 38 and fins welded between the water tubes 38. The water tube walls 24 are pairwise joined together so as to form a rectangular horizontal cross section, having four corner sections 26.

FIG. 1 also shows a steam drum 42, from where circulating water is conveyed in a conventional manner through downcomer pipes 44, 46 and lower headers 28, only one of which is seen in FIG. 1, to the water tubes 38 of the water tube walls 24. The steam drum 42 is advantageously arranged on top of downcomer pipes 44 so as to be supported by the downcomer pipes 44. Water is evaporated in the water tubes 38, and a mixture of steam and water is conveyed through an upper header 48 and steam pipes 50 back to the steam drum 42 in order to provide steam for further use. Due to the circulating water, thermal expansion of the downcomer pipes 44, 46 is nearly as large as that of the tube walls 24 of the boiler pressure body 22.

In accordance with the present invention, the boiler pressure body 22 is not supported on the support steel construction 14 in a conventional manner at multiple points of the lower headers 28 of the water tube walls 24, but by using four vertical columns 30 arranged outside the boiler pressure body 22. In the embodiment shown in FIG. 1, the vertical columns are defined by the downcomer pipes 44, 46. In other possible embodiments, the vertical columns can be other boiler pipes than downcomer pipes, such as steam pipes. In still other embodiments, the vertical columns may be other columns than boiler pipes, for example hollow vertical beams.

Because the water tube walls 24 are not supported from below but from their sides, by the four vertical columns 30, the risk for bulging of the water tube walls is minimized. Thereby, conventional horizontal buckstays 56 can be arranged even at the lower portion of the water tube walls 24 with such mutual distances that there is enough space for arranging fuel feeders 58, and other desired equipment, on the water tube walls.

According to the present invention, adjacent to each of the corner sections 26 is arranged one of the four vertical columns 30. Each of the vertical columns 30 is in the vertical direction rigidly attached to the respective corner section 24 by a vertically extending metal strip 32. The metal strips are advantageously dimensioned so as to provide sufficient thermal conductivity between the corner sections 26 and the respective vertical columns 30. The temperature difference between corner sections 26 and the vertical columns 30 has to be in any operating condition relatively small in order to avoid unnecessary thermal fatigue.

Figure 2A:
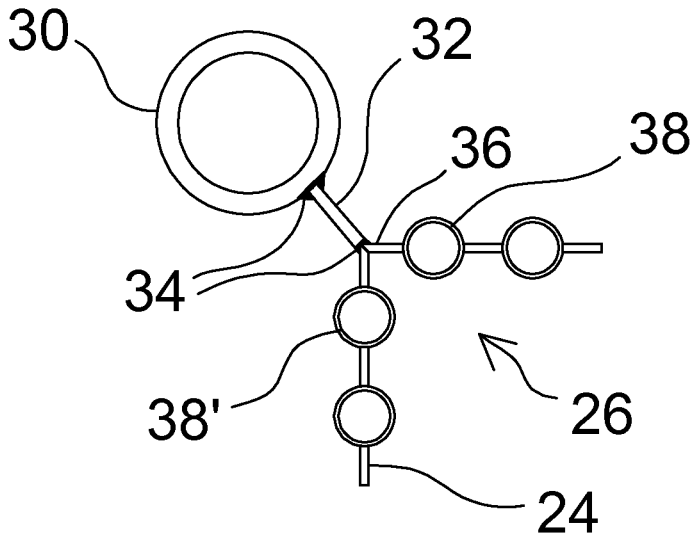
FIGS. 2*a* and 2*b* schematically illustrate two embodiments of a detail of a boiler according to the present invention.
Figure 2B:
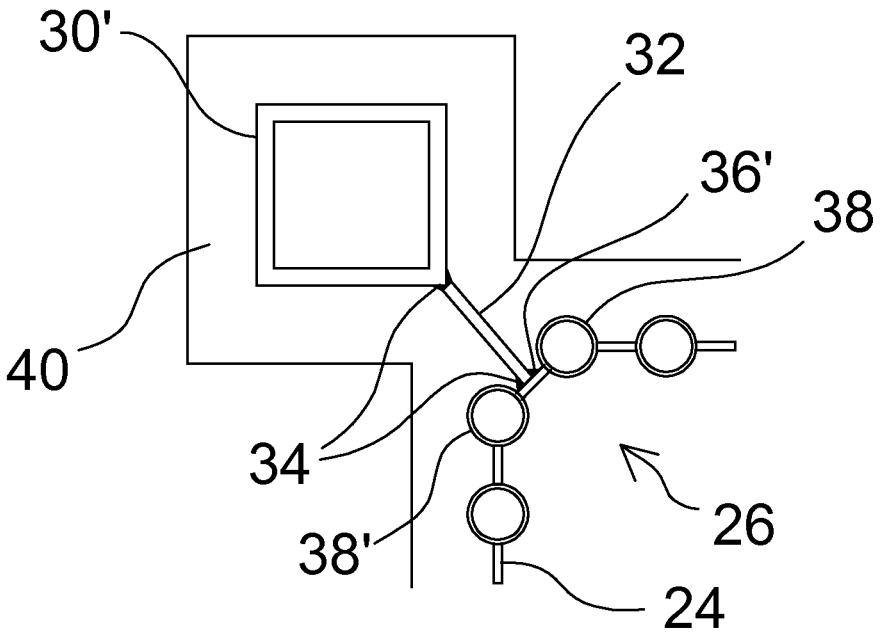

FIGS. 2*a* and 2*b* show, in more detail, two examples of attaching a vertical column 30, 30' to the corner section 26 of two water tube walls 24. In FIG. 2*a*, the vertical column 30 is a downcomer pipe, or another relatively thick walled boiler pipe. In FIG. 2*b*, the vertical column 30' is a hollow vertical beam with a square cross-sectional shape. As shown in FIGS. 2*a* and 2*b*, the metal strips 32 are preferably attached by continuous welds 34 to the vertical columns 30, 30' and to a corner fin 36, 36' between outermost water tubes 38, 38' of the water tube walls 24 forming the corner section 26. In the embodiment of FIG. 2*a*, the corner fin 36 makes a corner, whereas the corner fin 36' in FIG. 2*b* is beveled.

In FIGS. 2*a* and 2*b*, the metal strip 32 is at an angle of forty-five degrees to the water tube walls 24, but, in practice, the metal strip can alternatively be parallel to a water tube wall, or in another suitable angle to the walls. FIG. 2*b* schematically also shows insulation 40 surrounding both the water tube walls 24 and the vertical column 30', which is necessary to maintain the vertical column and the water tube walls 24 at a uniform temperature. It should be understood that corresponding insulation is also to be used in the embodiment of FIG. 2*a*.

Figure 3:
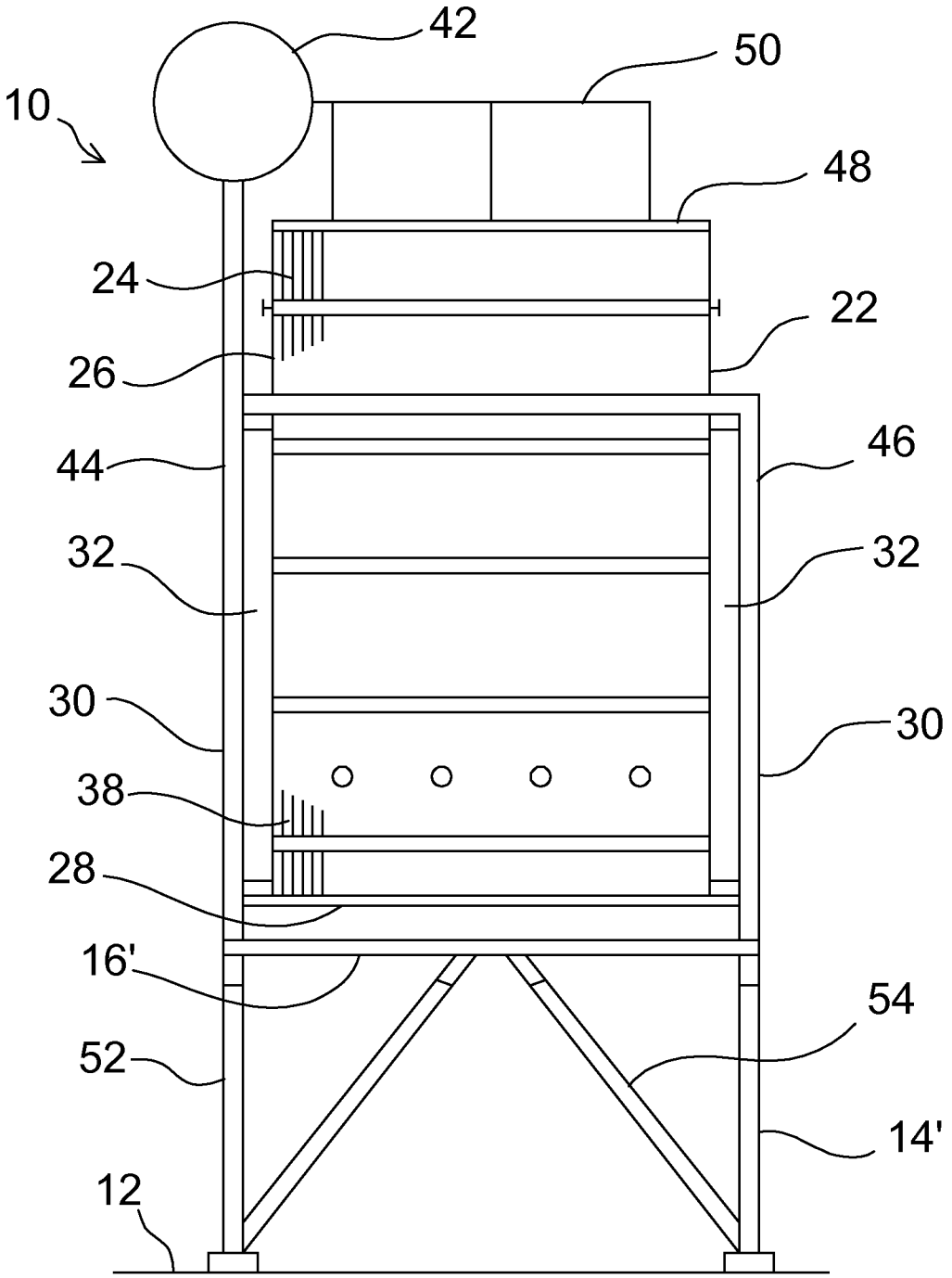
FIG. 3 schematically illustrates a side view of a boiler according to a second preferred embodiment of the present invention.

As mentioned above, in the embodiment of FIG. 1 the support steel construction 14 below the boiler pressure body is rigid, and horizontal thermal expansion is taken into account by slidingly supporting at least a portion of the vertical columns 30 to the support steel construction 14. FIG. 3 shows another embodiment of the present invention that differs from the embodiment of FIG. 1 only in that instead of being rigid, the support steel construction 14' arranged below the boiler pressure body 22 is designed to be flexible. Thereby, the flexible support steel construction 14' renders sufficient bending of the support steel construction possible, to allow horizontal thermal expansion of the planar water tube walls without using sliding elements between the vertical columns and the support steel construction. The support steel construction comprises second vertical columns 52 below each of the above described vertical columns 30 adjacent to the corner sections 26. The flexible support steel construction may also comprise diagonal braces 54 from the bottom portion of the second vertical columns 52 to a central section of a horizontal beam 16 in the upper portion of the support steel construction 14'. It should be noted that in the embodiment of FIG. 3 the second vertical columns 52 and diagonal braces 54 are connected to the insulated, hot vertical columns 30 and horizontal beams 16', respectively, whereas in the embodiment of FIG. 1, the support steel construction 14 comprises an upper horizontal 16 beam that is nearly at the ambient temperature.

As becomes clear from the discussion above, different embodiments of a bubbling fluidized bed boiler with a simple and reliable supporting construction of a bottom-supported boiler are provided. It should be understood that the elements described in connection with an embodiment also can be used in other embodiments, when possible. Corresponding supporting constructions are also applicable in a number of other applications, such as a furnace, a convection cage in connection with a furnace, an empty pass in connection with a furnace, a solid separator in connection with a furnace, or a horizontal pass in connection with a furnace.

While the invention has been described herein by way of examples in connection with what are at present considered to be the most preferred embodiments, it is to be understood that the invention is not limited to the disclosed embodiments, but is intended to cover various combinations or modifications of its features and several other applications included within the scope of the invention as defined in the appended claims.

The invention claimed is:

1. A bottom-supported boiler comprising:

a boiler pressure body having a rectangular horizontal cross section formed by joining four planar water tube walls pairwise together so as to form four corners with water tube walls being formed with fins welded between the water tubes; and a support construction comprising four vertical columns vertically supported to the ground, the vertical columns being arranged outside of the boiler pressure body so that adjacent to each of the corners is arranged one of the four vertical columns, wherein each of the vertical columns is directly connected with a rigid joint to a respective corner so that vertical loads of the boiler pressure body are balanced by the four vertical columns, and so that the water tube walls are supported from their sides by the four vertical columns so that the weight of the boiler pressure body is transferred through the vertical columns, and such that each of the four vertical columns is directly attached to a respective corner.

2. A bottom-supported boiler in accordance with claim 1, wherein vertical loads of the boiler pressure body are balanced solely by the four vertical columns.

3. A bottom-supported boiler in accordance with claim 1, wherein each of the four vertical columns is attached to the respective corner section in a region having a height of at least 30% of the height of the boiler pressure body.

4. A bottom-supported boiler in accordance with claim 3, wherein each of the four vertical columns is attached to the respective corner section in a region having a height of at least 60% of the height of the boiler pressure body.

5. A bottom-supported boiler in accordance with claim 1, wherein each of the four columns is attached to the respective corner by a continuous metal strip so as to provide, in a vertical direction, a rigid joint.

6. A bottom-supported boiler in accordance with claim 5, wherein the attaching is made with continuous welds.

7. A bottom-supported boiler in accordance with claim 6, wherein the attaching is made to a corner fin between outermost water tubes of the water tube walls forming the corner.

8. A bottom-supported boiler in accordance with claim 1, wherein at least a portion of the four vertical columns is supported to the ground by using sliding elements so as to allow horizontal thermal expansion of the planar water tube walls.

9. A bottom-supported boiler in accordance with claim 8, wherein each of the vertical columns is supported to the ground by a support steel construction below the vertical column.

10. A bottom-supported boiler in accordance with claim 1, wherein the multiple vertical columns are supported to the ground by a support steel construction allowing bending of the support steel construction so as to allow horizontal thermal expansion of the planar water tube walls and a horizontal beam of the support steel construction.

11. A bottom-supported boiler in accordance with claim 10, wherein the support steel construction comprises a steel column below each of the four vertical columns.

12. A bottom-supported boiler in accordance with claim 1, wherein at least one of the multiple vertical columns is a boiler pipe.

13. A bottom-supported boiler in accordance with claim 12, wherein the boiler pipe is a downcomer pipe of the boiler.

14. A bottom-supported boiler in accordance with claim 1, wherein at least one of the four vertical columns is a column that is not a water pipe.

15. A bottom-supported boiler in accordance with claim 14, wherein the at least one of the four vertical columns has a square cross section.

16. A bottom-supported boiler in accordance with claim 1, wherein each of the four vertical columns is arranged inside a common thermal insulation with the boiler pressure body.

17. A bottom-supported boiler in accordance with claim 1, wherein the boiler is a bubbling fluidized bed boiler.

18. A bottom-supported boiler in accordance with claim 1, wherein the boiler pressure body is one of (i) a furnace, (ii) a convection cage in connection with a furnace, (iii) an empty pass in connection with a furnace, (iv) a solid separator in connection with a furnace, and (v) a horizontal pass in connection with a furnace.

* * * * *